US008118578B2

(12) United States Patent
McIntyre

(10) Patent No.: US 8,118,578 B2
(45) Date of Patent: Feb. 21, 2012

(54) ROTARY PUMP WITH SLIDING CRESCENTOID ROTOR BODIES

(76) Inventor: John McIntyre, Traverse City, MI (US)

( * ) Notice: Subject to any disclaimer, the term of this patent is extended or adjusted under 35 U.S.C. 154(b) by 713 days.

(21) Appl. No.: 12/334,054

(22) Filed: Dec. 12, 2008

(65) Prior Publication Data

US 2010/0150763 A1 Jun. 17, 2010

(51) Int. Cl.
*F01C 19/00* (2006.01)
*F04C 2/00* (2006.01)

(52) U.S. Cl. ..... 418/142; 418/54

(58) Field of Classification Search ..... 418/142, 418/54

See application file for complete search history.

(56) References Cited

U.S. PATENT DOCUMENTS

| | | | | |
|---|---|---|---|---|
| 984,904 | A * | 2/1911 | Greene | 418/54 |
| 2,205,705 | A * | 6/1940 | Whitehurst | 418/142 |
| 4,030,861 | A * | 6/1977 | Putz | 418/54 |
| 4,300,874 | A * | 11/1981 | Georgiev | 418/54 |
| 4,507,067 | A | 3/1985 | Hansen | |
| 4,519,206 | A | 5/1985 | van Michaels | |
| 4,938,671 | A | 7/1990 | Thompson | |
| 5,032,069 | A | 7/1991 | Parsons | |
| 5,472,327 | A | 12/1995 | Strikis et al. | |
| 2006/0233653 | A1 | 10/2006 | Trapalis | |

* cited by examiner

*Primary Examiner* — Mary A Davis

(57) ABSTRACT

A rotary pump device includes a stator chamber with a cylindrical inner wall having intake and exhaust ports therein, and a two-part, expanding rotor eccentrically mounted for rotation within the chamber. The rotor comprises two crescentoid bodies with end surfaces in sliding, mating contact. A spring rod is placed between the inner rotor body surfaces to maintain rotor contact points in continuous wiping contact with the chamber wall. A full intake/exhaust cycle occurs every 180° of rotor travel.

11 Claims, 3 Drawing Sheets

ROTARY PUMP WITH SLIDING CRESCENTOID ROTOR BODIES

FIELD OF THE INVENTION

This invention is in the field of pumps, and more particularly rotary pumps of the type having a stator chamber with inlet and outlet ports.

BACKGROUND OF THE INVENTION AND DESCRIPTION OF RELATED ART

The term "pump" is used herein to refer to a device comprising a stator chamber or housing and a rotor that rotates within the chamber to cause sequential intake, compression, and exhaust of a fluid medium such as a gas, a liquid, or a combination thereof. The term, therefore, comprehends not only devices that cause fluid movement but also devices that compress or pressurize fluids with or without ignition and combustion. Further, the term "pump" embraces a reverse operation in which fluid drives a rotor rather than the rotor driving the fluid; i.e., in reverse operation every pump is effectively a motor.

One example of a rotary pump is the well-known Wankel engine that uses an ellipsoid stator chamber and a triangular rotor with seals at the corners.

Another example of a rotary pump is shown in U.S. Pat. No. 4,507,067 to Hansen. The pump in the Hansen patent comprises an elliptical, non-expanding rotor within an elliptical chamber with co-located geometric and rotational centers. The device is characterized by complexity in the number of radially sliding seals required.

BRIEF SUMMARY OF THE INVENTION

The present invention comprises a pump structure having a stator chamber with a substantially continuous inner wall with intake and exhaust ports formed therein. The pump further comprises an eccentrically mounted, cyclically expanding, two-part rotor mounted within the chamber such that as the rotor rotates, the rotor parts shift in position to maintain a wiping contact between the trailing edges of the rotor parts and the inner wall of the chamber to effect intake, compression, and exhaust functions with each 180° of rotor movement.

In an illustrative embodiment, the chamber wall is cylindrical and the rotor comprises a pair of crescentoid rotor bodies (each being less than semi-cylindrical, or covering less than 180°, in outer circumference; but of essentially constant radius, so as to form a body with an elliptical outer surface when the bodies are joined) with outer surface contours conforming to the inner surface contours of the chamber wall, so that within each 180° of rotation one rotor body lies fully and conformingly against the chamber wall while the other rotor body is maximally separated or spaced from the wall, the intake port is full open, and the exhaust port is full closed.

In the illustrative embodiment, the crescentoid rotor bodies have end surfaces that abut and slide over one another to effect rotor expansion and contraction. A spring-biased pin or rod interconnects the inner diameters of the rotor bodies to urge them outwardly into continuous wiping contact with the chamber wall.

In accordance with a preferred embodiment hereafter described, the trailing rotor body edges that contact the stator wall are chamfered to reduce initial wear. The intake and exhaust ports are opposite one another [and offset] along a chord that intersects the rotor axis. As will be understood from the following specification, the pump of the present invention can be scaled to any desired capacity and constructed using any material or combination of materials including hard, dense plastics such as HDPE, ceramics, cermets, and/or metals.

These and other features and advantages of the invention will become apparent from the detailed description below, in light of the accompanying drawings.

DETAILED DESCRIPTION OF THE INVENTION

Figure 1:
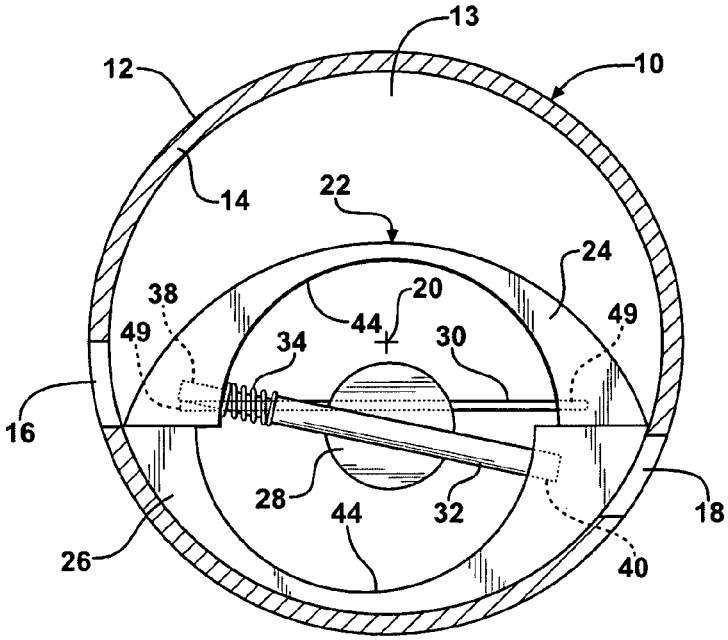
FIG. 1 is a plan view of a pump embodying the invention with the rotor in an offset position that opens an intake port and closes an exhaust port.
Figure 3:
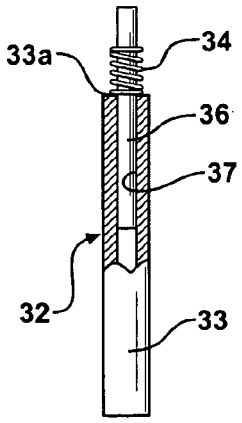
FIG. 3 is a side view, partly in section, of a detail of the FIG. 1 pump.
Figure 5:
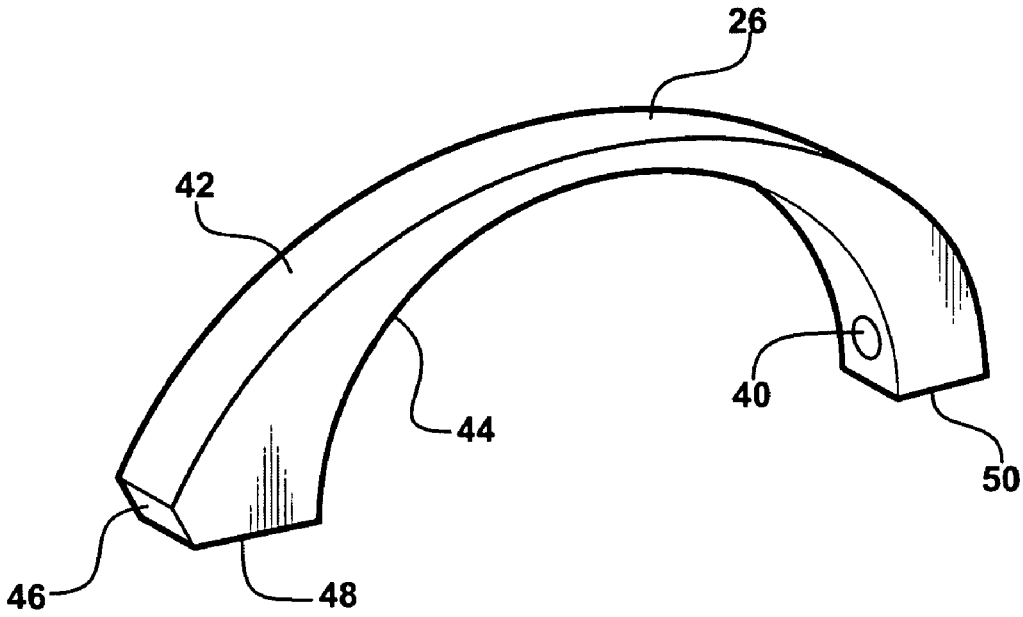
FIG. 5 is an isometric view of one rotor body with a preferred edge structure.

Referring to FIGS. 1, 3 and 5, there is shown a pump 10 comprising a stator 12 defining a cylindrical chamber having an inner wall 14 interrupted only by intake (inlet) and exhaust (outlet) ports 16 and 18, respectively. The stator chamber has a floor 13 and it will be understood that a cover plate or other structure (not shown) closes the chamber when all of the parts described in the following are installed. The chamber is cylindrical as defined by the inner wall, and has a geometric center at 20.

A rotor 22 comprises substantially identical crescentoid bodies 24 and 26 mounted end-to-end for rotation with an input structure 28. Each rotor body has an outer surface 42 with a diameter equal to the diameter of the wall 14 and an inner surface 44 of a smaller diameter such that, when the rotor 22 is in the expanded condition shown in FIG. 2, the inner surfaces 44 form a circle. Each rotor part also has end surfaces shown at 48 and 50 in FIG. 5 and these end surfaces slidingly abut one another when the rotor 22 is installed in the chamber.

The crescentoid rotor bodies 24, 26 are identical but asymmetrically installed; i.e., the end surfaces 48, 50 differ in depth and area and the bodies are arranged such that the larger end surface (e.g. 48) of one body abuts the smaller end surface (e.g. 50) of the other body. With rotation in a clockwise direction when viewing the pump 10 as in FIG. 2, the trailing edges of the larger ends are the contact or wiping surfaces and are preferably chamfered as shown at 46 in FIG. 5 to pre-wear the rotor bodies and improve seal function.

Blind holes 38 and 40 are formed in the inner surfaces 44 of the rotor bodies to receive an end of a connecting spring pin 32 shown in detail in FIG. 3. The connecting pin 32 comprises a hollow metal (e.g. steel or brass) rod 33, a pin 36 which fits slidingly into the rod 33, and a compression spring 34 which is attached to the pin 36 at one end and rests against the end shoulder 33*a* of the rod 33. Inserted into the blind holes 38, 40, pin 32 resiliently urges the trailing portions of the rotor bodies into continuous contact with wall 14. The spring pin 32 is fully compressed in FIG. 1 as the rotor bottoms out against the base of the chamber, forcing the rotor bodies inwardly, and is fully expanded in FIG. 2.

Figure 2:
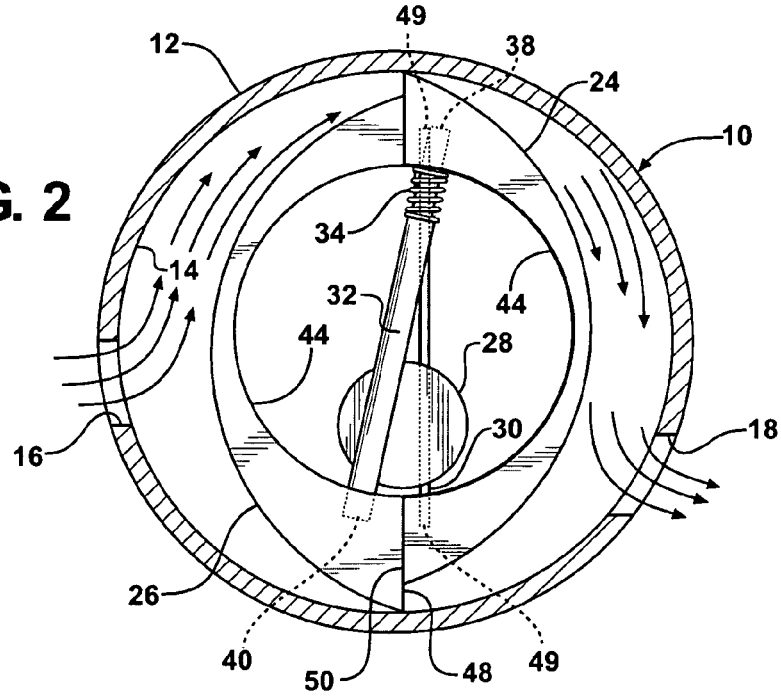
FIG. 2 is another plan view of the pump with the rotor displaced approximately 90° from the position shown in FIG. 1, and in a fully expanded condition.

Rotor drive comes from driven post or shaft 28, the center of which defines the rotor axis of rotation. As can be seen in FIGS. 1 and 2, the axis of rotation is displaced from the geometric stator center 20. The rotor drive post 28 is connected to rotor body 24 by means of a drive pin 30 passing in sliding fashion through a bore in post 28 and connected at both ends to rotor body 24 in holes 49. (Pin 30 might alternately be slidingly secured at one end in the bore or a blind hole in post 28 and connected at the other end to rotor body 24, with sufficient length to maintain the drive connection throughout the pump cycle.)

Figure 4A:
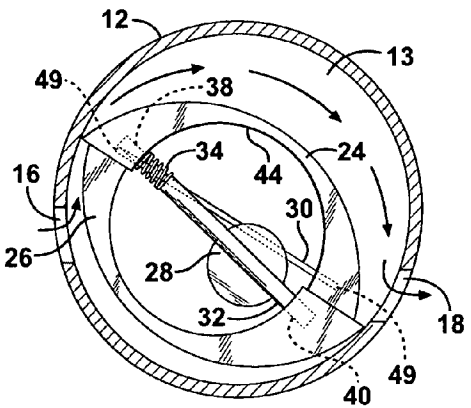
FIGS. 4A-4F make up a schematic, sequential showing of rotor position and fluid flow over approximately 180° of rotation.
Figure 4B:
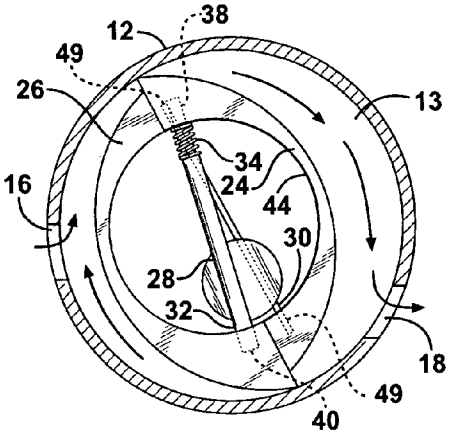
Figure 4C:
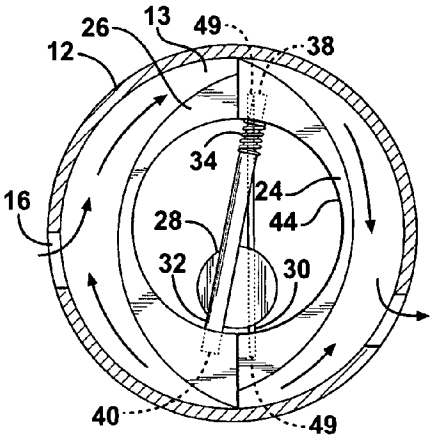

Referring now to FIGS. 4A-4F, a description of operation will be given. FIGS. 4A-4F represent progressively different degrees of rotor position over about 180° (degrees) of travel in a clockwise direction. FIG. 4C corresponds in rotor position to FIG. 2 and FIG. 4F corresponds in rotor position to FIG. 1.

Figure 4D:
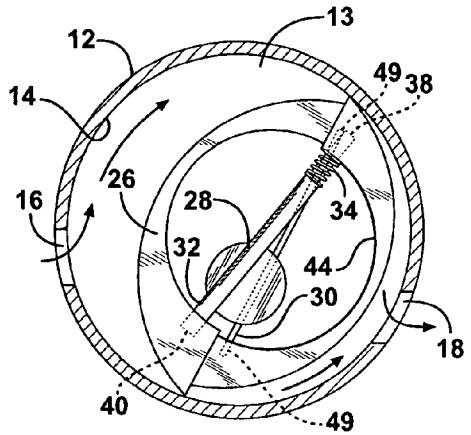
Figure 4E:
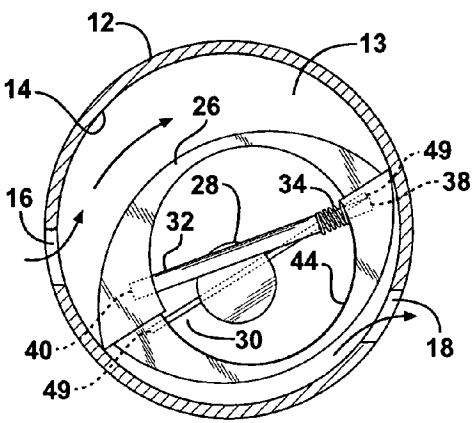
Figure 4F:
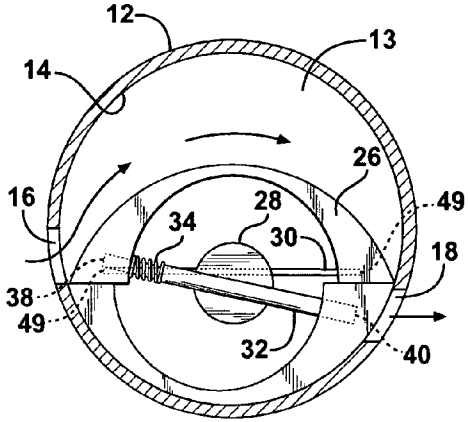

In FIG. 4A, the rotor 22 is partly expanded and is positioned such that both intake and exhaust ports 16, 18 are open. Fluid begins to flow into the intake port 16 and the compression of the fluid in the volume above and to the right of the rotor is just beginning. In FIGS. 4B and 4C, the intake volume to the left of the rotor 22 continues to expand, creating suction that pulls fluid into the pump while the right hand volume continues to grow smaller. In FIGS. 4D-4F the intake volume grows to maximum and the exhaust volume quickly goes to zero, expelling all fluid through port 16. The cycle repeats every 180° of rotation.

Pump 10 can also be driven in reverse operation as a motor, in which fluid entering the stator chamber drives the rotor 22 rather than the rotor pumping the fluid through the chamber. Fluid pumped into exhaust port 18 will thus rotate the rotor 22 in reverse, i.e. counterclockwise in the Figures, until exiting the chamber through inlet 16 in a reverse of the 180° cycle described in reference to FIGS. 4A-4F. Rotor 22 driven by the fluid entering exhaust port 18 accordingly rotates post 28 via pin 30 to effect work at some point outside the pump 10.

It may also be possible to make the stator's inner wall 14 circular over only a portion of its circumference, for example by making the "base" of the wall 14 where the rotor bodies 24, 26 bottom out (FIGS. 1 and 4F) of constant and thus circular diameter, and by making some portion of the remainder of wall 14 a non-circular shape, such as egg-shaped. This would reduce the amount of rotor travel, and allow the trailing edges of the rotor bodies to maintain a wiping seal with inner wall 14 with less shifting movement.

It will finally be understood that the disclosed embodiments represent presently preferred forms of the invention, but are intended to be explanatory rather than limiting of the invention. Reasonable variation and modification of the invention as disclosed in the foregoing disclosure and drawings are possible without departing from the scope of the invention. The scope of the invention is defined by the following claims.

What is claimed:

1. A rotary pump comprising:

a stator defining a substantially closed chamber having a substantially continuous inner wall, with an intake port and an exhaust port being formed in the inner wall at spaced-apart locations;

a rotor eccentrically mounted within the chamber and in contact with the inner wall;

the rotor comprising a pair of crescentoid bodies with end surfaces disposed in end-to-end sliding contact with each other and rotatable together about an axis of rotation; and, a spring element disposed between the pair of crescentoid bodies to urge at least a contact point on each of the crescentoid bodies into continuous wiping contact with the inner wall during rotor rotation.

2. A rotary pump as defined in claim 1, wherein the contact points are adjacent the trailing ends of the pair of crescentoid bodies.

3. A rotary pump as defined in claim 2, wherein the contact points are chamfered.

4. A rotary pump as defined in claim 1, wherein each of the crescentoid bodies includes an outside surface that conforms to the inside surface of the inner wall.

5. A rotary pump as defined in claim 4, wherein each of the crescentoid bodies is circumferentially asymmetric such that the leading end surfaces are smaller than the trailing end surfaces, the contact points being at the trailing end surfaces and capable of sliding radially outwardly to expand the effective rotor diameter.

6. A rotary pump as defined in claim 1, wherein the spring element comprises an elongate rod extending between inside rotor body surfaces of the pair of crescentoid bodies, and a compression spring carried by the rod.

7. A rotary pump as defined in claim 1, wherein the materials of construction for the pair of crescentoid bodies are chosen from the group consisting of plastics, ceramics, cermets and metals.

8. A rotary pump as defined in claim 1, wherein the inner wall is circular.

9. A rotary pump as defined in claim 1, wherein the inner wall is circular over a portion of its circumference corresponding to a rotary position of the rotor in which the outer circumference of one of the pair of crescentoid bodies is bottomed out against the inner wall.

10. A rotary pump as defined in claim 1, further comprising an axial drive post located eccentrically in the chamber with respect to a geometric center of the chamber.

11. A rotary pump as defined in claim 10, wherein one of the pair of crescentoid bodies is driven by a radial drive pin slidingly connected to the axial drive post and secured to the one of the pair of crescentoid bodies.

* * * * *